US005133658A

United States Patent [19]

Le Monnier De Gouville et al.

[11] Patent Number: 5,133,658

[45] Date of Patent: Jul. 28, 1992

[54] GAS BURNER, PARTICULARLY FOR HOUSEHOLD APPLIANCES, ADAPTED SO AS TO BE SECURED AGAINST THE EFFECTS OF HIGH FLUCTUATIONS OF THE PRIMARY AIR PRESSURE

[75] Inventors: Jean-Bernard Le Monnier De Gouville, Joue Les Tours; Bernard Dane, Montbazon, both of France

[73] Assignee: Sourdillon, France

[21] Appl. No.: 669,086

[22] Filed: Mar. 15, 1991

[30] Foreign Application Priority Data

Mar. 15, 1990 [FR] France ..... 90 03336

[51] Int. Cl.[5] ..... F23D 14/06; F23D 14/58

[52] U.S. Cl. ..... 431/349; 431/114; 431/350; 126/39 R; 239/567

[58] Field of Search ..... 431/114, 157, 264, 265, 431/266, 346, 350, 354, 349, 278; 126/39 R, 39 E, 39 K; 239/559, 567

[56] References Cited

U.S. PATENT DOCUMENTS 4,757,801 7/1988 LeMonnier de Gouville et al. ..... 626/39 H

FOREIGN PATENT DOCUMENTS 2121103 11/1972 Fed. Rep. of Germany ..... 431/266

2598486 11/1987 France ..... 126/34 R

*Primary Examiner*—Carl D. Price

*Attorney, Agent, or Firm*—Larson and Taylor

[57] ABSTRACT

Gas burner, particularly for household appliances, comprising a burner body (1) having a peripheral side wall (5) defining an enclosure with an outward opening and at least one air-gas mixture supply orifice (13), which enclosure is adapted to contain a "soft" flame able to withstand sudden pressure variations of the primary air brought to the burner and to re-activate the flames of the burner should they be blown out, characterized in that it further comprises at least one chamber (15) situated behind the supply orifice (13) of said enclosure (11) and itself having a gas mixture supply orifice (16) with a cross section substantially equal to or greater than that of the supply orifice (13) of the enclosure, this chamber being configured so that the air-gas mixture which is contained therein forms a buffer cancelling out or attenuating the sudden pressure variations of the primary air admitted into the burner and so that the flame of the enclosure is maintained.

6 Claims, 1 Drawing Sheet

GAS BURNER, PARTICULARLY FOR HOUSEHOLD APPLIANCES, ADAPTED SO AS TO BE SECURED AGAINST THE EFFECTS OF HIGH FLUCTUATIONS OF THE PRIMARY AIR PRESSURE

BACKGROUND OF THE INVENTION

The present invention relates to improvements to gas burners, particularly for household appliances such as cookers or cooking plates, comprising a burner body having a peripheral side wall with flame orifices distributed circumferentially, this peripheral wall being further formed so as to define at least one outwardly open enclosure into which opens at least one supply orifice whose cross section is such that it ensures a flow speed of the combustible air-gas mixture equal or close to the flow speed through the other flame orifices, the volume of this enclosure being such that it allows expansion of the gas mixture so that the pressure inside the enclosure is equal or close to the static pressure and the cross section of the outlet opening of this enclosure being such that the flow speed of the gas mixture which passes through it is from about 7 to 12 times less than the speed of the gas flow through the flame orifices.

It is known that sudden pressure variations of the primary air fed into a gas burner for being mixed therein with the combustible gas may cause the flames of the burner to disappear during slow running.

It has already been proposed (U.S. Pat. No. 4,757,801) to overcome this drawback by providing, at the level of the peripheral wall of the burner body which is provided with the flame orifices, an outwardly open enclosure into which opens at least one supply orifice whose cross section is such that it ensures a flow speed of the airgas fuel mixture equal or close to the flow speed through the other flame orifices, the volume of this enclosure being such that it allows expansion of the gas mixture so that the pressure inside the enclosure is equal or close to the static pressure and the cross section of the outlet opening of this enclosure being such that the flow speed of the gas mixture which passes through it is from about 7 to 12 times less than the speed of the flow speed feeding the flame orifices.

Such an arrangement is quite satisfactory when the pressure variation of the primary air remains at a relatively moderate value, being due for example to the sudden opening or closing of the door of the oven of a cooker embedded between other furniture or else to a draught of average violence.

On the other hand, this arrangement is inefficient when the pressure variation of the primary air is very sudden and very considerable, being due for example to a very violent draught sweeping over the burner or else to the cumulation of a draught and a pressure jump caused by closing or opening the door of the oven.

SUMMARY OF THE INVENTION

The object of the invention is therefore essentially to provide a new improvement for reinforcing the stability of the flames of a gas burner, while keeping a burner structure which is simple to manufacture and whose production cost is not substantially increased.

To these ends, a gas burner of said type adapted in accordance with the invention is essentially characterized in that it further comprises at least one chamber situated behind the supply orifice of said enclosure and itself having a gas mixture supply orifice with a cross section substantially equal or greater than that of the supply orifice of the enclosure, the volume of this chamber being sufficient for the air-gas mixture which is contained therein to form a buffer cancelling out or attenuating the sudden pressure variations of the primary air admitted into the burner and so that the flame of the enclosure is maintained.

Thus, with the outwardly open enclosure which is occupied by a "soft" flame which it is desired to be inextinguishable, there is associated a supply chamber or buffer chamber filled with a gas mixture volume which forms a buffer and which is capable of damping out all the pressure variations undergone by the primary air. The "soft" flame of the burner thus adapted is therefore secured, to a much greater extent than in presently known burners, from the disturbing influences of the pressure variations of the primary air fed into the gas burner and this "soft" flame remains live in most of the traditional blowing out cases. Re-lighting of the burner is thus ensured and operating safety is increased in considerable proportions.

Advantageously, the enclosure has two gas mixture supply orifices and two chambers situated respectively behind said two orifices, each chamber having its own gas mixture supply orifice.

Preferably, the two chambers are situated symmetrically on each side of the enclosure and are partially defined by the side wall of the burner body; thus a structure is obtained which is mechanically robust and which is just as easy to manufacture by moulding as the prior art structures.

In a preferred embodiment, each chamber is further provided with at least one flame orifice in the side wall of the burner body and the supply orifice of each chamber is dimensioned so as to provide a sufficient air-gas mixture flow for supplying the enclosure and the associated "hard" flame orifice. Thus, although the presence of the two buffer chambers results in an increase in size, in the circumferential direction, of the system generating the "soft" flame, this presence is not penalizing in so far as the total number of flames of the burner is concerned, particularly in burner configurations having several (for example 2 or 4) "soft" flame generating enclosures. Of course, in this case, the supply orifices of the buffer chamber(s) must have consequently an increased cross section and advantageously the cross section of the supply orifice of each buffer chamber represents 1.65 times the cross section of the inlet opening of the "soft" flame enclosure.

The advantage presented by an adaptation according to the invention is all the higher the shorter the distance between the injector and the flames, in other words the smaller the intermediate volume between the injector and flames. The arrangements of the invention will therefore be more particularly interesting for flat type burners (used particularly in cooking plates) comprising a burner body which has an axial, vertical and cylindrical gas feed passage housing a gas injector and which is covered by a cap, the annular surface of the burner body bordering the outlet of said gas feed passage and/or the surface of the cap situated opposite being of a truncated cone-shape so as to define an annular convergent-divergent system extending approximately transversely to the gas jet, an annular decompression chamber further extending between said convergentdiverqent system and the side wall having the flame orifices.

BRIEF DESCRIPTION OF THE DRAWINGS

The invention will be better understood from the following detailed description of a preferred embodiment given solely by way of example; in this description, reference is made to the accompanying drawings in which.

DETAILED DESCRIPTION OF THE PREFERRED EMBODIMENT

Figure 1:
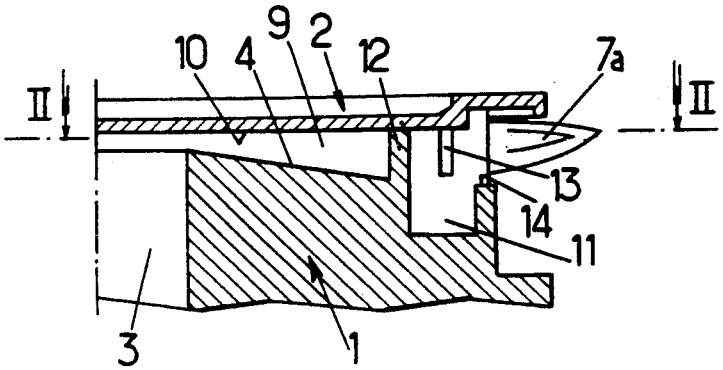
FIG. 1 is a partial half view in diametrical cross section through line I—I of FIG. 2, of a flat type gas burner adapted in accordance with the invention.
Figure 2:
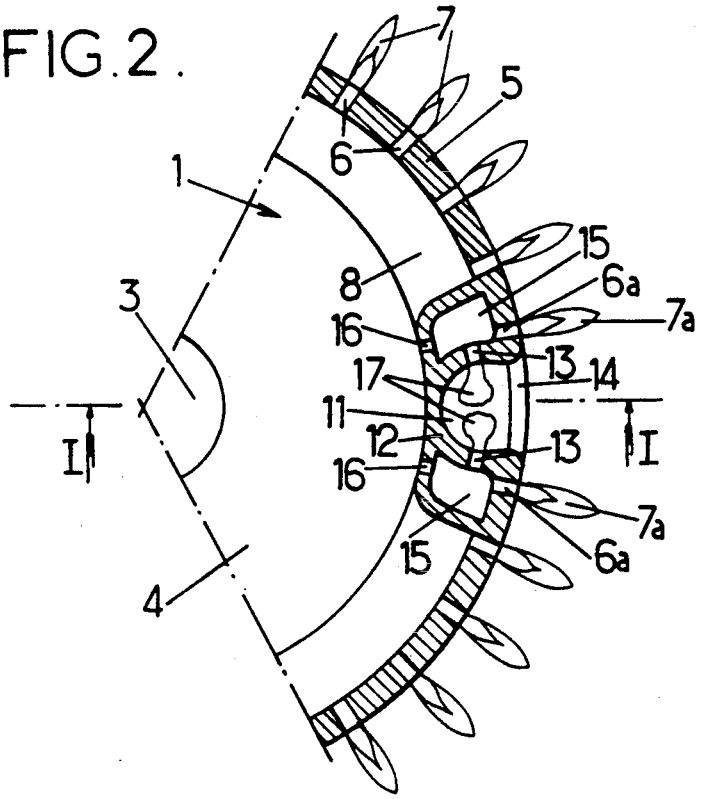
FIG. 2 is a partial top view, through line II—II, of the burner of FIG. 1.

In FIGS. 1 and 2, only the elements of the burner have been shown which are necessary to understanding of the invention.

The burner shown fragmentarily in FIGS. 1 and 2 comprises essentially a burner body 1 and a cap 2 covering it.

The burner body 1 has a gas feed passage 3 which is axial, vertical and cylindrical and which is provided at its base with a gas injector (not shown). The annular upper face 4 of the burner body 1 which surrounds the upper outlet of the vertical passage 3 is inclined radially from top to bottom from the center outwardly, so as to form a truncated cone-shaped surface. The burner body 1 has a peripheral side wall 5, projecting upwards, which serves as support for cap 2 and which is formed with orifices 6 for the heating flames 7.

Between the annular truncated cone-shaped face 4 and the side wall 5 there extends an annular recessed portion 8.

In such an arrangement of a flat type gas burner, an annular convergent-divergent system 9 is defined between the truncated cone-shaped surface 4 and the lower face 10 of cap 2, whereas the recessed portion 8 forms a decompression chamber for the gas mixture.

According to the arrangements of the patent U.S. Pat. No. 4,757,801, on the periphery of the burner body an outwardly open enclosure 10 is provided communicating through at least one supply orifice 11 with the inside of the burner body. This enclosure is defined by an approximately semicircular inwardly turned set-back of the side wall 4 of the burner body. Furthermore, the cross section of the supply orifice 11 is such that it provides a flow speed of the gas mixture which is equal or close to the flow speed through the flame orifices 5. In addition, the volume of enclosure 10 is such that it allows expansion of the gas mixture so that the pressure inside enclosure 10 is equal or close to the static pressure. Finally, the cross section of the outlet opening 13 of enclosure 10 is such that the flow speed of the gas mixture is about 7 to 12 times less than the speed of the gas flow feeding the flame orifices 5.

In accordance with the invention, a chamber 15 is further provided which is situated behind the supply orifice 13 of enclosure 11 and which is provided with its own supply orifice 16 having a cross section substantially identical to that of orifice 13.

Chamber 15 is thus filled with a volume of gas mixture which serves as buffer between the burning gas mixture in enclosure 11 where it provides a "soft" flame 17 and the inner volume of the burner where the primary air mixed with the gas delivered by the injector may undergo sudden pressure variations of great amplitude.

However, experience has shown that the stability of the "soft" flame 17 is further enhanced when two buffer chambers 15 are associated with enclosure 11, each having its own supply orifice 16 and each communicating with enclosure 11 through an orifice 13.

To reduce as much as possible the inside dimension of the burner body and obtain a mechanically strong structure easy to manufacture using a conventional moulding technique, the two chambers 15 are situated on each side of enclosure 11, immediately behind the peripheral wall 5 of the burner body 2, as shown in FIG. 2.

It is then possible to provide a flame orifice 6a in the portion of the peripheral wall defining each buffer chamber 15, which flame orifice 6a is fed by the gas mixture contained in the buffer chamber 15. The result is, it is true, a slight reduction of pressure therewithin, but this reduction of pressure has no appreciable effect on the formation of the "soft" flame 17 and its stability. This arrangement thus offers the advantage of not reducing the number of heating flames 7 and so of not affecting the efficiency of the burner in normal operation.

Tests carried out with a burner adapted in accordance with the representation of FIGS. 1 and 2 have shown that the volume of the buffer chamber 15 was not critical, and the stability of the "soft" flame 17 was ensured for a ratio $$\frac{\text{volume of buffer chamber 15}}{\text{volume of enclosure 11}}$$

varying between 25% and 65%. On the other hand, the cross section of the supply orifice 16 of each buffer chamber 15 should represent at least about 1.65 times the cross section of the inlet opening 13 of enclosure 11, so that in normal operation the air-gas mixture is fed with appropriate respective flows to the orifices 6a and 13 so as to ensure the life of the "hard" flames 7a and the "soft" flame 17, respectively.

Comparative blowing out tests have been carried out with a pendulum, in accordance with the directions of standards NF D32-321 and D32-322. In a conventional burner without "soft" flame enclosure, the flames were extinguished after a single passage of the pendulum initially spaced away by 30°. In a burner adapted with a "soft" flame enclosure according to the patent FR 2 598 486, the "soft" flame continues to exist after a single passage of the pendulum spaced away initially by 30° or slightly more, but it is extinguished by a larger blast (pendulum having a substantially greater initial angular spacing). Finally, in a burner adapted in accordance with the present invention, the "soft" flame continues to exist for any inclination of the pendulum, and even after a double passage thereof initially spaced away by 90° of more.

With the arrangements according to the invention, the "soft" flame for re-activating the burner can be maintained under difficult operating conditions of the burner, which conditions may for example correspond to a violent draught sweeping over the burner and to a sudden pressure variation of the primary air due for example to the opening or closing of the door of an underlying oven.

The arrangements according to the invention are all the more advantageous the lower the distance between the injector and the flames; in other words, these arrangements are applicable to all types of gas burners, but they find a quite particularly advantageous application in flat type gas burners as was explained above, and shown in the accompanying drawings.

As is evident, and as it follows moreover from the foregoing, the invention is in no wise limited to those of its modes of application and embodiments which have been more particularly considered; it embraces, on the contrary, all variants thereof.

We claim:

1. A gas burner, particularly for a domestic appliance, comprising:

a burner body having a peripheral side wall, main flame orifices distributed around said peripheral side wall, at least one recess in said peripheral side wall extending radially inwardly and being outwardly opened through an outlet opening, at least one combustible primary air-gas mixture supply orifice opening into said recess, said supply orifice having a cross-section sized such that the combustible mixture flows into said recess with a speed equal or close to a flow speed of the combustible mixture through said main flame orifices, said recess having such an inner volume that an expansion of said combustible mixture in said recess is possible in such a manner that pressure inside said recess is equal or close to static pressure and said outlet opening of said recess having a cross-section sized such that combustible mixture flowing through said outlet opening has a flow speed being from about 7 to 12 times less than the speed of the combustible mixture flowing through said main flame orifices, at least one chamber located inwardly behind said supply orifice of said recess, said chamber having a chamber inlet orifice with a cross-section substantially equal to or greater than said cross-section of said supply orifice of said recess, said chamber being shaped and sized so that combustible mixture contained therein is a buffer adapted to cancel out or to attenuate sudden pressure variations of the primary air admitted into said burner and so that a flame is maintained inside said recess whatever the pressure variations of the primary air.

2. A gas burner according to claim 1, including two supply orifices and two chambers located inwardly, one behind each supply orifice, each chamber having its own chamber light orifice.

3. A gas burner according to claim 2, wherein the two chambers are situated symmetrically on each side of the recess and are partially defined by the said peripheral side wall.

4. A gas burner according to claim 2, the two chambers being partially defined by a portion of the peripheral side wall, each chamber being provided with at least one main flame orifice in that portion of said peripheral side wall which partially defines that chamber, each chamber inlet orifice being dimensioned so as to provide a sufficient air-gas mixture flow for supplying the recess and its said main flame orifice.

5. A gas burner according to claim 2, wherein the cross-section of the chamber inlet orifice of each chamber is at least about 1.65 times the cross-section of the supply orifice of that chamber.

6. A flat type gas burner, particularly for household appliances, comprising a burner body which has a axial, vertical and cylindrical gas feed passage and which is covered by a cap, a truncated cone-shaped annular surface of the burner body bordering the outlet of said gas feed passage, an inner surface of the cap facing the annular surface and defining therebetween an annular outwardly divergent space extending approximately transversely to the gas feed passage, an annular decompression chamber located between said divergent space and a peripheral side wall of the burner body, said peripheral side wall having main flame orifices distributed around the peripheral side wall, at least one recess in said peripheral side wall extending radially inwardly and being outwardly opened through an outlet opening, at least one combustible primary air-gas mixture supply orifice opening into said recess, said supply orifice having a cross-section sized such that the combustion mixture flows into said recess with a speed equal or close to a flow speed of the combustible mixture through said main flame orifices, said recess having such an inner volume that an expansion of said combustible mixture in said recess is possible in such a manner that pressure inside said recess is equal or close to static pressure and said outlet opening of said recess having a cross-section sized such that combustible mixture flowing through said outlet opening has a flow speed being from about 7 to 12 times less than the speed of the combustible mixture flowing through said main flame orifices, at least one chamber located inwardly behind said supply orifice of said recess, said chamber having a chamber inlet orifice with a cross-section substantially equal to or greater than said cross-section of said supply orifice of said recess, said chamber being shaped and sized so that combustible mixture contained therein is a buffer adapted to cancel out or to attenuate sudden pressure variations of the primary air admitted into said burner and so that a flame is maintained inside said recess whatever the pressure variations of the primary air.

* * * * *